US010301061B2

(12) United States Patent
Walling et al.

(10) Patent No.: US 10,301,061 B2
(45) Date of Patent: May 28, 2019

(54) CARTON AND CARTON BLANK

(71) Applicant: WestRock Packaging Systems, LLC, Norcross, GA (US)

(72) Inventors: Bradford J. Walling, Chesterfield, VA (US); Ekaterina V. Gaidaeva, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/561,108

(22) PCT Filed: Mar. 23, 2016

(86) PCT No.: PCT/US2016/023677
§ 371 (c)(1),
(2) Date: Sep. 25, 2017

(87) PCT Pub. No.: WO2016/154247
PCT Pub. Date: Sep. 29, 2016

(65) Prior Publication Data

US 2018/0118405 A1 May 3, 2018

Related U.S. Application Data

(60) Provisional application No. 62/138,054, filed on Mar. 25, 2015.

(51) Int. Cl.
*B65D 5/44* (2006.01)
*B65D 5/468* (2006.01)

(52) U.S. Cl.
CPC ..... *B65D 5/443* (2013.01); *B65D 5/4608* (2013.01); *B65D 2571/00518* (2013.01); *B65D 2571/00524* (2013.01)

(58) Field of Classification Search
CPC ..... B65D 5/443; B65D 5/4608; B65D 2571/00518; B65D 2571/00524
See application file for complete search history.

(56) References Cited

U.S. PATENT DOCUMENTS 2,703,197 A 3/1955 Brasch
3,989,181 A 11/1976 Wilcox et al.
(Continued)

FOREIGN PATENT DOCUMENTS

DE 7428781 U 1/1975
WO WO 2007/022482 A1 2/2007

*Primary Examiner* — Corey N Skurdal
(74) *Attorney, Agent, or Firm* — WestRock Intellectual Property Group

(57) ABSTRACT

A carton for packaging one or more articles. The carton includes a plurality of panels for forming a tubular structure. The plurality of panels forming a tubular structure includes a first side wall panel, a first end wall panel, a second side wall panel; and second end wall panel. The carton includes a first handle structure defined in a first one of the plurality of panels. The first handle structure includes a severance line defining at least in part a handle opening. The carton includes a first end closure panel forming, at least in part, top wall which at least partially closes an upper end of the tubular structure and which is hingedly connected to the first one of the plurality of panels by a first hinged connection. The carton includes a first reinforcing flap hingedly connected to the first end closure panel by a second hinged connection. The second hinged connection is offset from the first hinged connection.

12 Claims, 8 Drawing Sheets

(56) References Cited

U.S. PATENT DOCUMENTS

| | | | | |
|---|---|---|---|---|
| 4,037,777 | A | 7/1977 | Maughan | |
| 4,240,545 | A * | 12/1980 | Stout | B65D 71/0022 206/188 |
| 4,967,901 | A | 11/1990 | Wood | |
| 2008/0190785 | A1* | 8/2008 | Spivey | B65D 71/066 206/147 |
| 2014/0021071 | A1 | 1/2014 | O'Neal | |
| 2017/0313469 | A1* | 11/2017 | Hayslette | B65D 5/18 |
| 2017/0327266 | A1* | 11/2017 | Zacherle | B65D 71/0022 |

* cited by examiner

CARTON AND CARTON BLANK

CROSS-REFERENCE TO RELATED APPLICATIONS

This application is a National Phase application of PCT Application PCT/US16/23677, filed Mar. 23, 2016, which claims the benefit of U.S. Provisional Patent Application No. 62/138,054, filed Mar. 25, 2015, both of which are incorporated herein by reference in their entirety.

TECHNICAL FIELD

The present invention relates to a carton and blank for forming the same more specifically, but not exclusively, to a carton comprising a reinforced handle structure.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

It is desirable to provide a carton comprising a handle structure for forming a carrying handle to transport the carton. The carrying handle must be sufficiently robust and strong to withstand the load of the carton contents.

The present invention seeks to overcome or at least mitigate the problems of the prior art.

SUMMARY

According to a first aspect of the present invention there is provided a carton for packaging one or more articles. The carton comprises a first panel and a second panel hingedly connected by a first hinged connection to the first panel. The first panel comprises a handle structure. The handle structure may comprise a severance line defining at least in part a handle opening. The second panel comprises a reinforcing flap hingedly connected to the second panel by a second hinged connection. The second hinged connection is offset from the first hinged connection.

Optionally, the second hinged connection is spaced apart from the first hinged connection and is parallel to the first hinged connection.

Optionally, the second hinged connection is inset into the second panel so as to be spaced apart from the first hinged connection.

Optionally, the reinforcing flap is struck at least in part from the second panel.

Optionally, the carton further includes a third panel opposing the first panel and fourth and fifth opposed panels each extending between the first and third panel such that the first, third, fourth and fifth panels together provide a tubular structure, wherein the second panel forms a dust flap for at least partially closing one of opposed ends of the tubular structure.

Optionally, the first panel has a width extending between fourth and fifth panels, wherein the first hinged connection extends substantially entirely along the width of the first panel.

Optionally, the first hinged connection is greater in length than the second hinged connection.

Optionally, the handle structure includes a handle flap defining at least in part the handle opening.

Optionally, the reinforcing flap comprises a first handle reinforcing panel and a second handle reinforcing panel hinged to the first handle reinforcing panel along a third hinged connection.

Optionally, the first and second hinged connections are spaced apart at a first distance, the second and third hinged connections are spaced apart at a second distance, and the first distance is generally equal to the second distance.

Optionally, at least one of the first and second handle reinforcing panels is secured to at least one of the first and second panels.

Optionally, the second handle reinforcing panel comprises a cutaway shaped complementary to the handle opening.

Optionally, the second handle reinforcing panel comprises at least one cushioning flap which defines at least in part the cutaway.

Optionally, the second panel is defined at least in part by a pair of opposed free side edges each extending from the first hinged connection, and wherein the second hinged connection is spaced apart from the opposed free side edges.

According to a second aspect of the present invention there is provided a blank for forming a carton. The blank comprises a first panel and a second panel hingedly connected by a first hinged connection to the first panel. The first panel comprises a handle structure. The handle structure may comprise a severance line defining at least in part a handle opening. The second panel comprises a reinforcing flap hingedly connected to the second panel by a second hinged connection. The second hinged connection is offset from the first hinged connection.

Optionally, the second hinged connection is spaced apart from the first hinged connection and is parallel to the first hinged connection.

Optionally, the second hinged connection is inset into the second panel so as to be spaced apart from the first hinged connection.

Optionally, the reinforcing flap is struck at least in part from the second panel.

Optionally, the second panel extends about at least one side of the reinforcing flap.

In some embodiments, the reinforcing flap comprises a first handle reinforcing panel and a second handle reinforcing panel hinged to the first handle reinforcing panel.

According to a third aspect of the present invention there is provided a carton for packaging one or more articles. The carton comprises a plurality of panels for forming a tubular structure. The plurality of panels comprises a first side wall panel, a first end wall panel, a second side wall panel and a second end wall panel. The carton comprises a first handle structure defined in a first one of the plurality of panels. The first handle structure may comprise a severance line defining at least in part a handle opening. The carton comprises a first end closure panel forming, at least in part, a top wall which at least partially closes an upper end of the tubular structure. The first end closure panel is hingedly connected to the first one of the plurality of panels by a first hinged connection. The carton comprises a first reinforcing flap hingedly connected to the first end closure panel by a second hinged connection. The second hinged connection is offset from the first hinged connection.

In some embodiments, the carton comprises a second handle structure defined in a second one of the plurality of panels. The second one of the plurality of panels opposes the first one of the plurality of panels. The first handle structure comprises a severance line defining at least in part a handle opening. The carton comprises a second end closure panel forming, at least in part, a top wall which at least partially closes an upper end of the tubular structure. The second end closure panel is hingedly connected to the second one of the plurality of panels by a third hinged connection. The carton comprises a second reinforcing flap hingedly connected to the second end closure panel by a fourth hinged connection. The fourth hinged connection is offset from the third hinged connection.

According to a fourth aspect of the present invention there is provided a blank for forming a carton. The blank comprises a plurality of panels for forming a tubular structure. The plurality of panels comprises a first side wall panel, a first end wall panel, a second side wall panel and a second end wall panel. The carton comprises a first handle structure defined in a first one of the plurality of panels. The first handle structure may comprise a severance line defining at least in part a handle opening. The carton comprises a first end closure panel forming, at least in part, a top wall which at least partially closes an upper end of the tubular structure. The first end closure panel is hingedly connected to the first one of the plurality of panels by a first hinged connection. The carton comprises a first reinforcing flap hingedly connected to the first end closure panel by a second hinged connection. The second hinged connection is offset from the first hinged connection.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the packages, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figures 1, 1A:
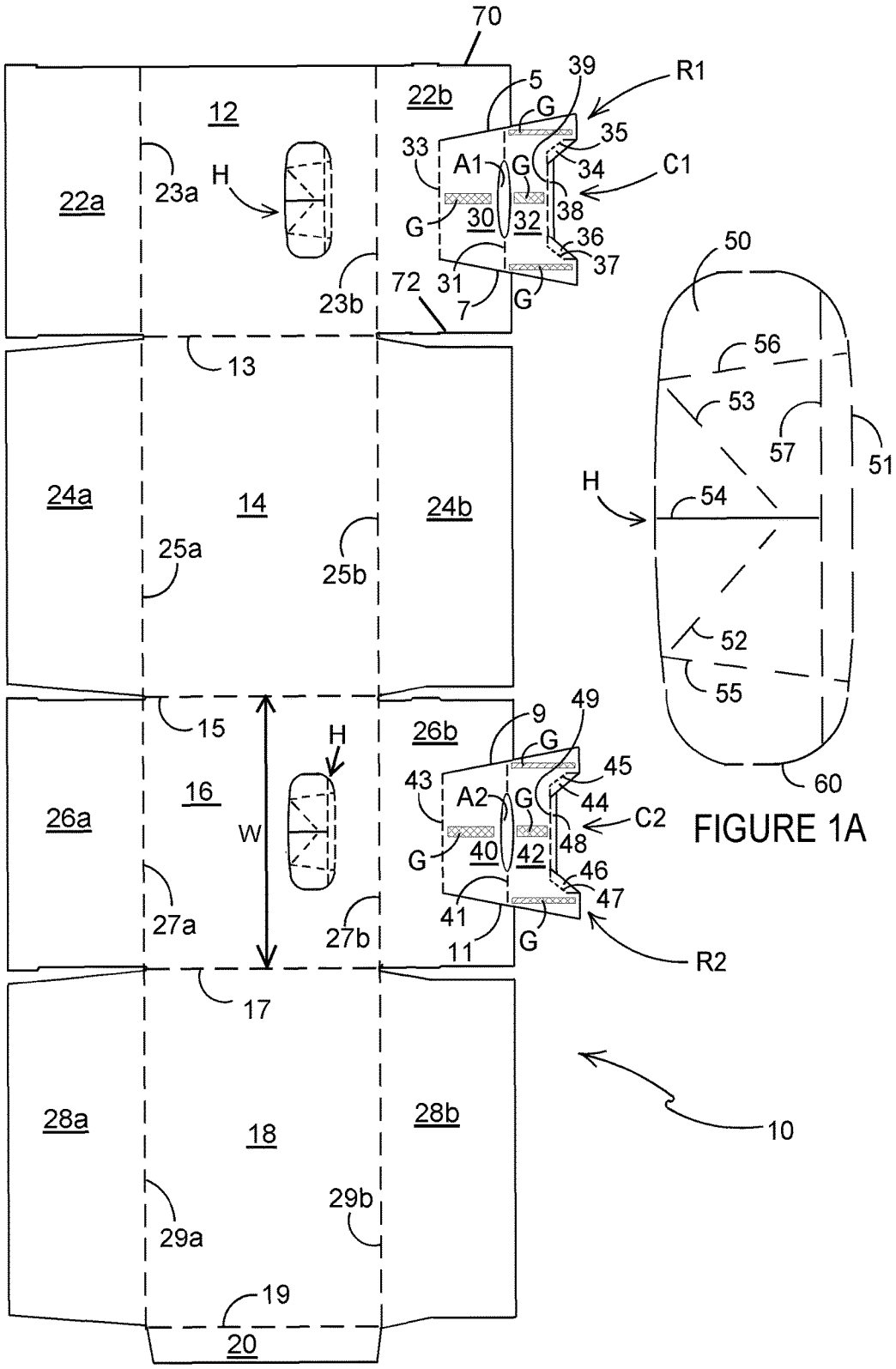
FIG. 1 is a plan view from above of a blank for forming a carton according to an embodiment of the invention.
FIG. 1A illustrates an enlarged view of a handle structure H for use with the blank of FIG. 1.
Figure 2:
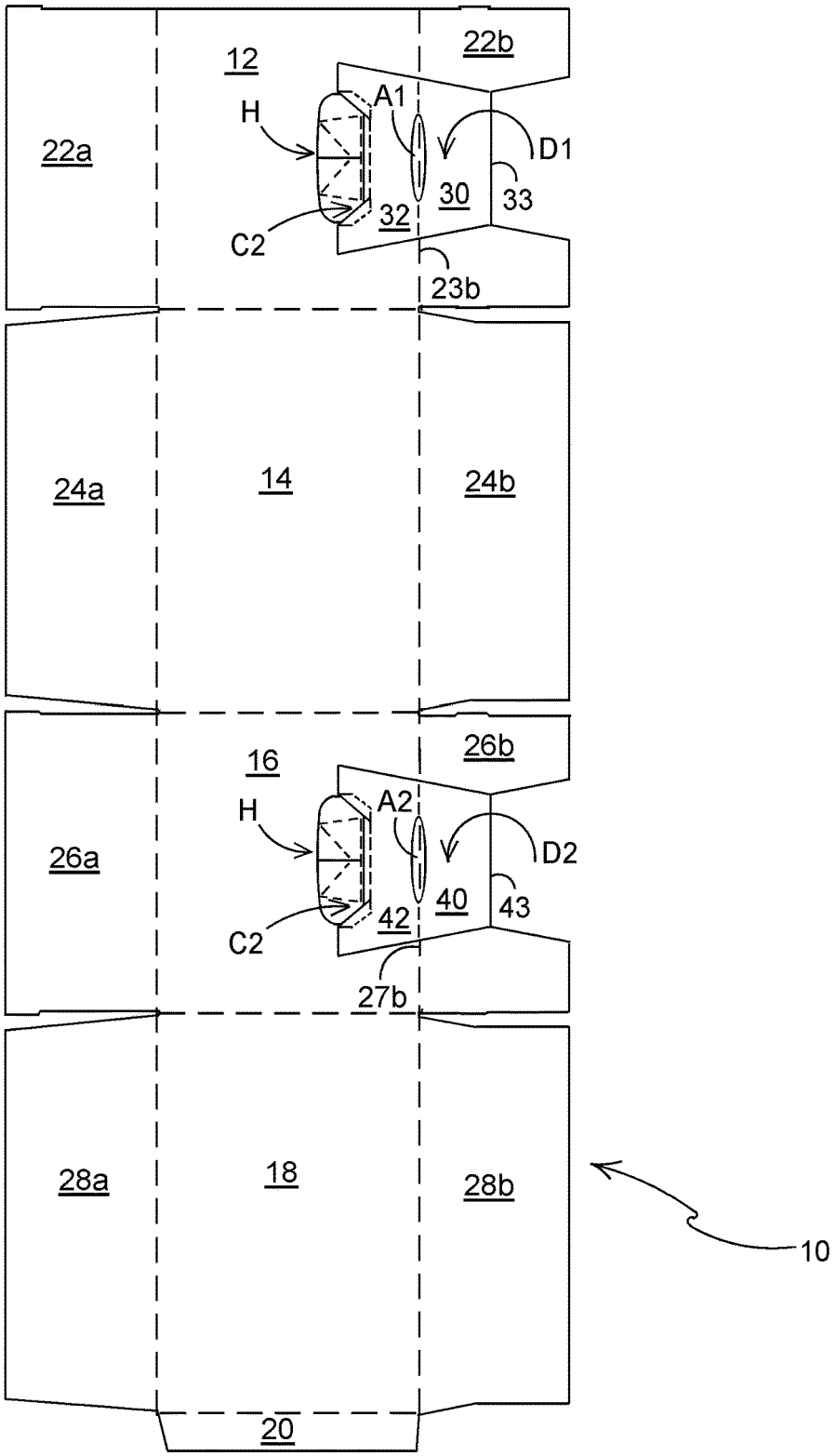
FIGS. 2 to 6 illustrate stages of construction of a carton from the blank of FIG. 1.
Figure 3:
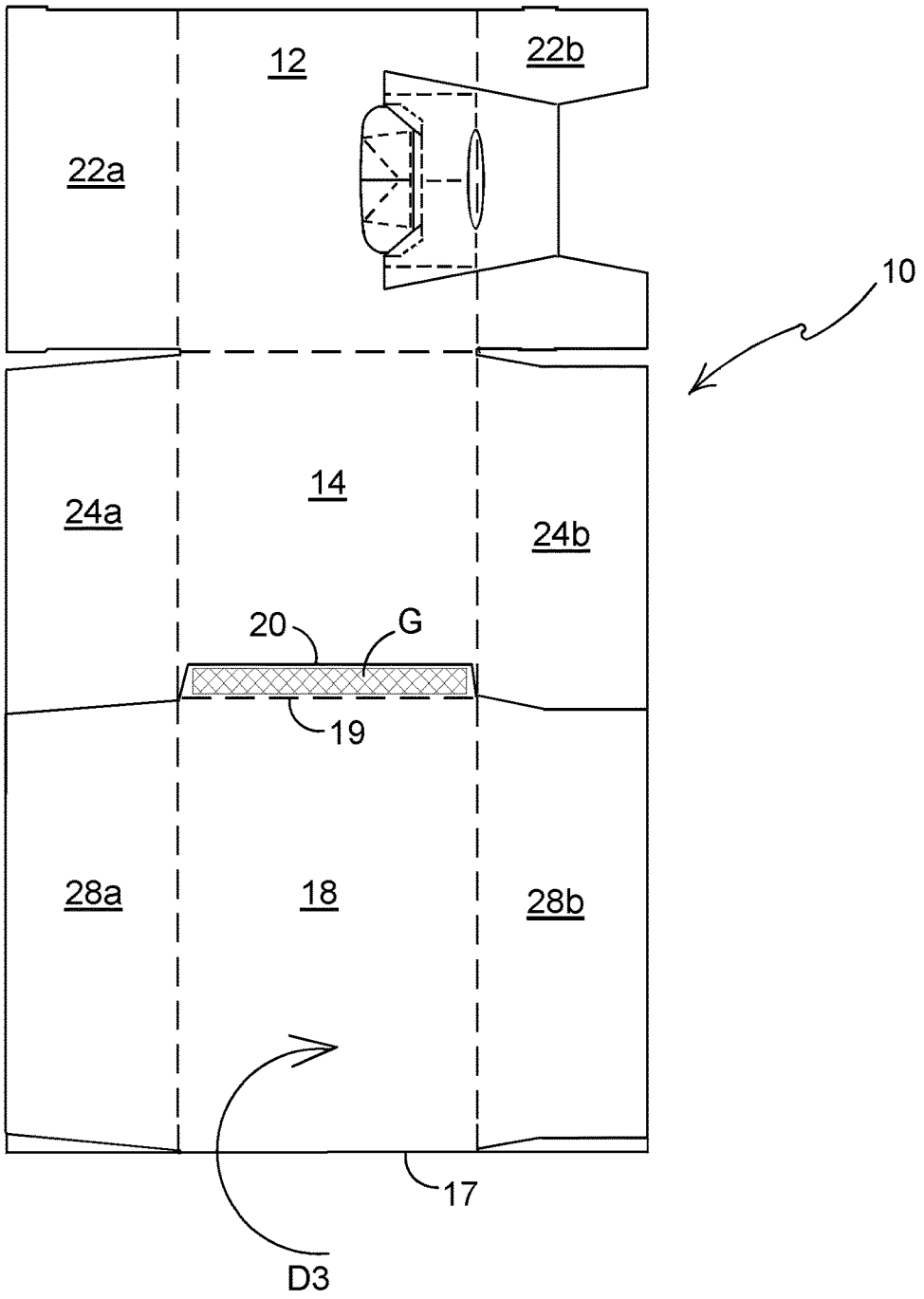
Figure 4:
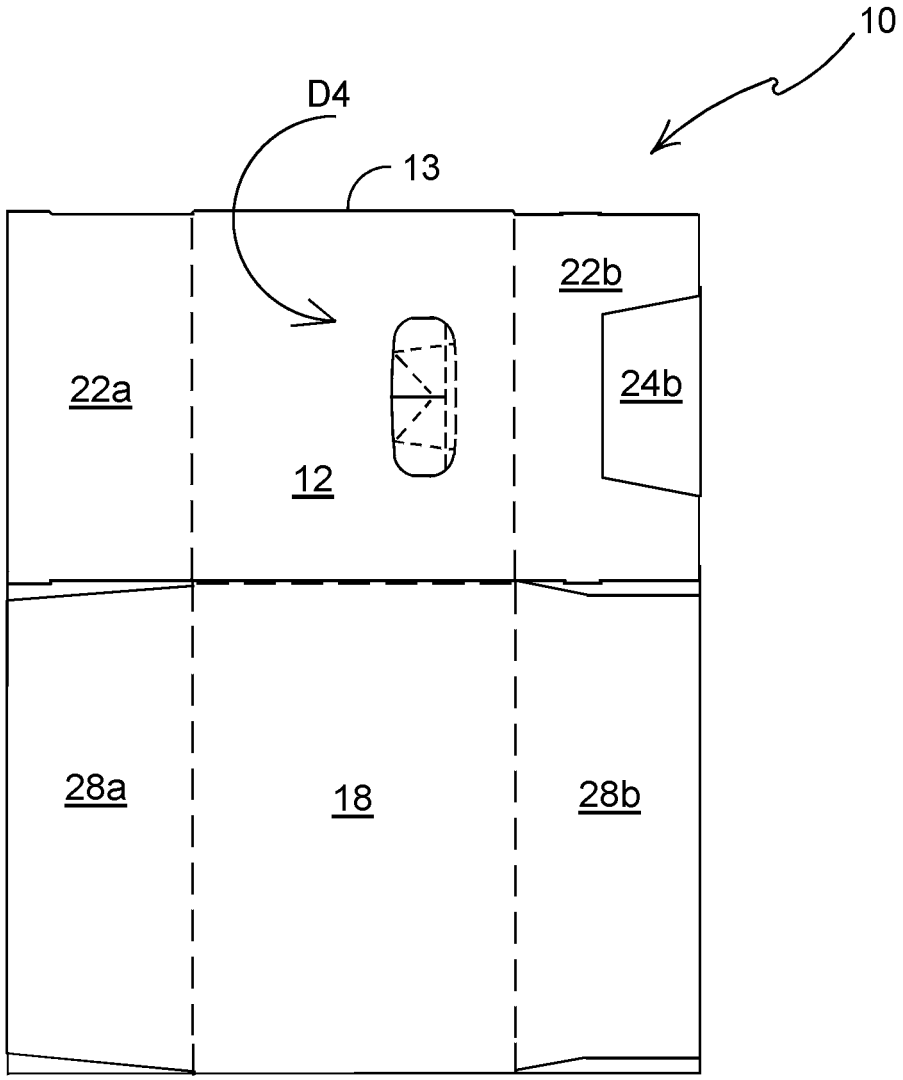

Referring to FIGS. 1 and 2 there is shown a blank 10 for forming a carton 90 capable of accepting an input of primary products such as, but not limited to, bottles or cans, hereinafter referred to as articles B.

The blank 10 comprises a plurality of main panels 12, 14, 16, 18, 20 hinged one to the next in a linear series. A first side wall panel 12 is hinged to a first end wall panel 14 by a hinged connection such as a fold line 13. The first end wall panel 14 is hinged to a second side wall panel 16 by a hinged connection such as a fold line 15. The second side wall panel 16 is hinged to a second end wall panel 18 by a hinged connection such as a fold line 17. The second end wall panel 18 is hinged to a glue panel 20 by a hinged connection such as a fold line 19.

The plurality of main panels 12, 14, 16, 18, 20 of the blank 10 form walls of an open-ended tubular structure in a set up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment the ends of the tubular structure are fully closed by end closure panels 22*a*, 24*a*, 26*a*, 28*a*, 22*b*, 24*b* 26*b*, 28*b*.

End closure panels 22*a*, 24*a*, 26*a*, 28*a* are configured to close a first end of the tubular structure and form a composite base panel of a carton 90. End closure panels 22*b*, 24*b*, 26*b*, 28*b* are configured to close a second end of the tubular structure and form a composite top panel of a carton 90.

The first end of the tubular structure is closed by a first end closure panel 22*a*, a second end closure panel 24*a*, a third end closure panel 26*a* and a fourth end closure panel 28*a*. The first end closure panel 22*a* is hinged to a first end of the first side wall panel 12 by a hinged connection such as a fold line 23*a*. The second end closure panel 24*a* is hinged to a first end of the first end wall panel 14 by a hinged connection such as a fold line 25*a*. The third end closure panel 26*a* is hinged to a first end of the second side wall panel 16 by a hinged connection such as a fold line 27*a*. The fourth end closure panel 28*a* is hinged to a first end of the second end wall panel 18 by a hinged connection such as a fold line 29*a*.

The second end of the tubular structure is closed by a fifth end closure panel 22*b*, a sixth end closure panel 24*b*, a seventh end closure panel 26*b* and an eighth end closure panel 28*b*. The fifth end closure panel 22*b* is hinged to a second end of the first side wall panel 12 by a hinged connection such as a fold line 23*b*. The sixth end closure panel 24*b* is hinged to a second end of the first end wall panel 14 by a hinged connection such as a fold line 25*b*. The seventh end closure panel 26*b* is hinged to a second end of the second side wall panel 16 by a hinged connection such as a fold line 27*b*. The eighth end closure panel 28*b* is hinged to a second end of the second end wall panel 18 by a hinged connection such as a fold line 29*b*.

The first, third, fifth and seventh end closure panels 22*a*, 22*b*, 26*a*, 26*b* form minor end closure panels. The first, third, fifth and seventh end closure panels 22*a*, 22*b*, 26*a*, 26*b* may be disposed innermost.

The second, fourth, sixth and eighth end closure panels 24*a*, 24*b*, 28*a*, 28*b* form major end closure panels. The second, fourth, sixth and eighth end closure panels 24*a*, 24*b*, 28*a*, 28*b* may be disposed outermost.

The blank 10 comprises at least one handle structure H for forming a carrying handle H. The illustrated embodiment shows a first handle structure H formed in the first side wall panel 12 and a second handle structure H formed in the second side wall panel 16. In alternative embodiments a handle structure may be provided in either of the first or second end wall panels 14, 18. In still other embodiments a handle structure may be provided in each of the side and end wall panels 12, 14, 16, 18.

The first and second handle structures H are substantially the same in construction and will be described in further detail by reference to FIG. 1A which illustrates an enlarged view of a handle structure H.

The handle structure H comprises a flap 50 defined by a severance line 60 and a hinged connection in the form of a first fold line 51. The flap 50 defines an opening O (see FIG. 8) in a panel forming the carton 90 into which opening a user may insert at least a portion of their hand.

The flap 50 in the undeployed state acts as a dust cover preventing ingress of dirt into the carton 90. In the deployed state the flap 50 acts as a cushioning flap so as to make a comfortable carrying handle.

The flap 50 is hinged to the panel from which it is struck by the form of a "V" shape on a first side of the second severance line 54. The flap 50 may comprise an optional second fold line 57 disposed in parallel to the first fold line 51. Optionally the second fold line 57 is disposed proximate the first fold line 51. The flap 50 may comprise an optional second severance line 54 which extends between the second fold line 57 and the severance line 60 so as to substantially bisect the flap 50.

The flap 50 may optionally comprise a third fold line 52, a fourth fold line 53, a fifth fold line 55 and a sixth fold line 56 arranged in a substantially "W" shape. The third and fifth fold lines 52, 55 form a first "V" shape on a first side of the second severance line 54. The fourth and sixth fold lines 53, 56 form a second "V" shape on a second side of the second severance line 54. The fifth and sixth fold lines 55, 56 extend between the first fold line 51 and the severance line 60. The fifth and sixth fold lines 55, 56 are arranged divergently with respect to each other and diverge towards the first fold line 51. The second and third fold lines 52, 53 are arranged divergently with respect to each other and diverge towards the severance line 60.

The blank 10 comprises a first handle reinforcing structure R1 and a second handle reinforcing structure R2.

The first handle reinforcing structure R1 comprises a reinforcing flap including a first reinforcing panel 30 and a second reinforcing panel 32. The first reinforcing panel 30 is hinged to the fifth end closure panel 22*b* by a hinged connection in the form of a fold line 33. The first reinforcing panel 30 is hinged to the second reinforcing panel 32 by a hinged connection in the form of a fold line 31. The fold line 31 is interrupted by an elongate or oval aperture A1 which facilitates construction of the carton 90 by reducing the amount of material which must be folded.

The first handle reinforcing panel 30 may be struck at least in part from the fifth end closure panel 22*b*. The second reinforcing panel 32 may be struck at least in part from the fifth end closure panel 22*b*.

The first handle reinforcing panel 30 and the second handle reinforcing panel 32 are defined at least in part by a first severance or cut line 5 and a second severance or cut line 7.

The second reinforcing panel 32 comprises a cutaway C1. Cutaway C1 is shaped to be complementary to the shape of the opening defined by the flap 50.

The second reinforcing panel 32 may comprise one or more cushioning flaps 34, 36, 38. The illustrated embodiment comprises a first cushioning flap 34 hinged to second reinforcing panel 32 by a fold line 35, a second cushioning flap 36 hinged to the second reinforcing panel 32 by a fold line 37, and a third cushioning flap 38 hinged to the second reinforcing panel 32 by a fold line 39. Fold line 39 is arranged to be substantially parallel to fold line 31. Fold line 35 is arranged divergently with respect to fold line 39. Fold line 37 is arranged divergently with respect to fold line 39. Fold line 35 is convergently arranged with respect to fold line 37 and converges towards fold line 39.

The second handle reinforcing structure R2 comprises a reinforcing flap including a third reinforcing panel 40 and a fourth reinforcing panel 42. The third reinforcing panel 40 is hinged to the seventh end closure panel 26*b* by a hinged connection in the form of a fold line 43. The third reinforcing panel 40 is hinged to the fourth reinforcing panel 42 by a hinged connection in the form of a fold line 41. The fold line 41 is interrupted by an elongate or oval aperture A2 which facilitates construction of the carton 90 by reducing the amount of material which must be folded.

The third reinforcing panel 40 may be struck at least in part from the seventh end closure panel 26*b*. The fourth reinforcing panel 42 may be struck at least in part from the seventh end closure panel 26*b*.

The third handle reinforcing panel 40 and the fourth reinforcing panel 42 are defined at least in part by a first severance or cut line 9 and a second severance or cut line 11.

The fourth reinforcing panel 42 comprises a cutaway C2. Cutaway C2 is shaped to be complementary to the shape of the opening defined by the flap 50.

The fourth reinforcing panel 42 may comprise one or more cushioning flaps 44, 46, 48. The illustrated embodiment comprises a fourth cushioning flap 44 hinged to fourth reinforcing panel 42 by a fold line 45, a fifth cushioning flap 46 hinged to the fourth reinforcing panel 42 by a fold line 47 and a sixth cushioning flap 48 hinged to the fourth reinforcing panel 42 by a fold line 49. Fold line 49 is arranged to be substantially parallel to fold line 41. Fold line 45 is arranged divergently with respect to fold line 49. Fold line 47 is arranged divergently with respect to fold line 49. Fold line 45 is convergently arranged with respect to fold line 47 and converges towards fold line 49.

Referring to FIG. 1, the second side wall panel 16 has a width W which extends between the first and second end wall panels 14, 18, wherein the fold line 27*b* extends substantially entirely along the width W of the second side wall panel 16. In like manner, the fold line 23*b* also extends substantially entirely along the width of the first side wall panel 12. The fold line 27*b* is greater in length than the fold line 43.

The fold lines 23*b*, 33 are spaced apart at a first distance whereas the fold lines 33, 31 are spaced apart at a second distance such that the first distance is generally equal to the second distance. At least one of the first and second handle reinforcing panels 30, 32 is secured to at least one of the first side wall panel 12 and the fifth end closure panel 22*b*. In the illustrated embodiment, the first and second handle reinforcing panels 30, 32 are glued to the inside surfaces of the fifth end closure panel 22*b* and the first side wall panel 12, respectively.

The fifth end closure panel 22*b* is defined at least in part by the opposed free side edges 70, 72 each extending from the fold line 23*b*. The fold line 33 extends parallel with fold line 23*b*. However, fold line 33 does not extend all the way across the fifth end closure panel 22*b* but stops short of either of the free side edges 70, 72. Stated differently, the opposite ends of the fold line 33 are spaced apart from the free side edges 70, 72, respectively.

The carton 90 can be formed by a series of sequential folding operations in a straight line machine so that the carton 90 may not be required to be rotated or inverted to complete its construction. The folding process is not limited to that described below and may be altered according to particular manufacturing requirements.

Turning to the construction of the carton 90 as illustrated in FIGS. 2 to 7, glue G or other adhesive treatment is applied to an inner surface of the first handle reinforcing panel 30 and the second handle reinforcing panel 32. Alternatively, glue G or other adhesive treatment may be applied to a corresponding portion of an inner surface of the fifth end closure panel 22*b* and the first side panel 12.

Glue G or other adhesive treatment is applied to an inner surface of the third handle reinforcing panel 40 and the fourth handle reinforcing panel 42. Alternatively, glue G or other adhesive treatment may be applied to a corresponding portion of an inner surface of the seventh end closure panel 26*b* and the second side panel 16.

The blank 10 is folded (as indicated by direction arrow D1 in FIG. 2) about the fold line 33 such that the first handle reinforcing panel 30 is disposed in overlying relationship with the fifth end closure panel 22*b* and such that the second handle reinforcing panel 32 is disposed in face contacting relationship with the first side panel 12.

The first handle reinforcing panel 30 is secured to the fifth end closure panel 22*b*. The second handle reinforcing panel 32 is secured to the first side panel 12.

The blank 10 is folded (as indicated by direction arrow D2 in FIG. 2) about the fold line 43 such that the third handle reinforcing panel 40 is disposed in overlying relationship with the seventh end closure panel 26*b* and such that the fourth handle reinforcing panel 42 is disposed in face contacting relationship with the second side panel 16.

The third handle reinforcing panel 40 is secured to the seventh end closure panel 26*b*. The fourth handle reinforcing panel 42 is secured to the second side panel 16.

The blank 10 is folded about the fold line 17 (as indicated by direction arrow D3 in FIG. 3) such that the second end panel 18 is disposed in overlying relationship with the second side panel 16 and part of the first end panel 14. The glue panel 20 is disposed in overlying relationship with the first end panel 14.

Glue G or other adhesive treatment is applied to an outer surface of the glue panel 20. Alternatively, glue G or other adhesive treatment may be applied to a corresponding edge portion of an inner surface of the first side panel 12.

The blank 10 is folded about the fold line 13 (as indicated by direction arrow D4 in FIG. 4) such that the first side panel 12 is disposed in overlying relationship with the first end panel 14 and the glue panel 20. The first side panel 12 is secured to the glue panel 20.

The blank 10 is thus formed into a flat collapsed tubular structure which can be readily shipped or distributed to a convertor plant, at which the flat collapsed tubular structure may be erected into an open ended tubular structure and loaded with articles B.

The flat collapsed tubular structure may be erected to form an open-ended tubular structure by unfolding the first side panel 12 with respect to the first end panel 14 such that the first side panel 12 is disposed substantially perpendicularly with respect to the first end panel 14.

The carton 90, in its open ended tubular form, may be loaded with articles B through either or both open ends thereof.

It will be appreciated that in some embodiments one of the open ends of the carton 90 may be closed before loading the interior with articles B through the remaining open end.

Figure 5:
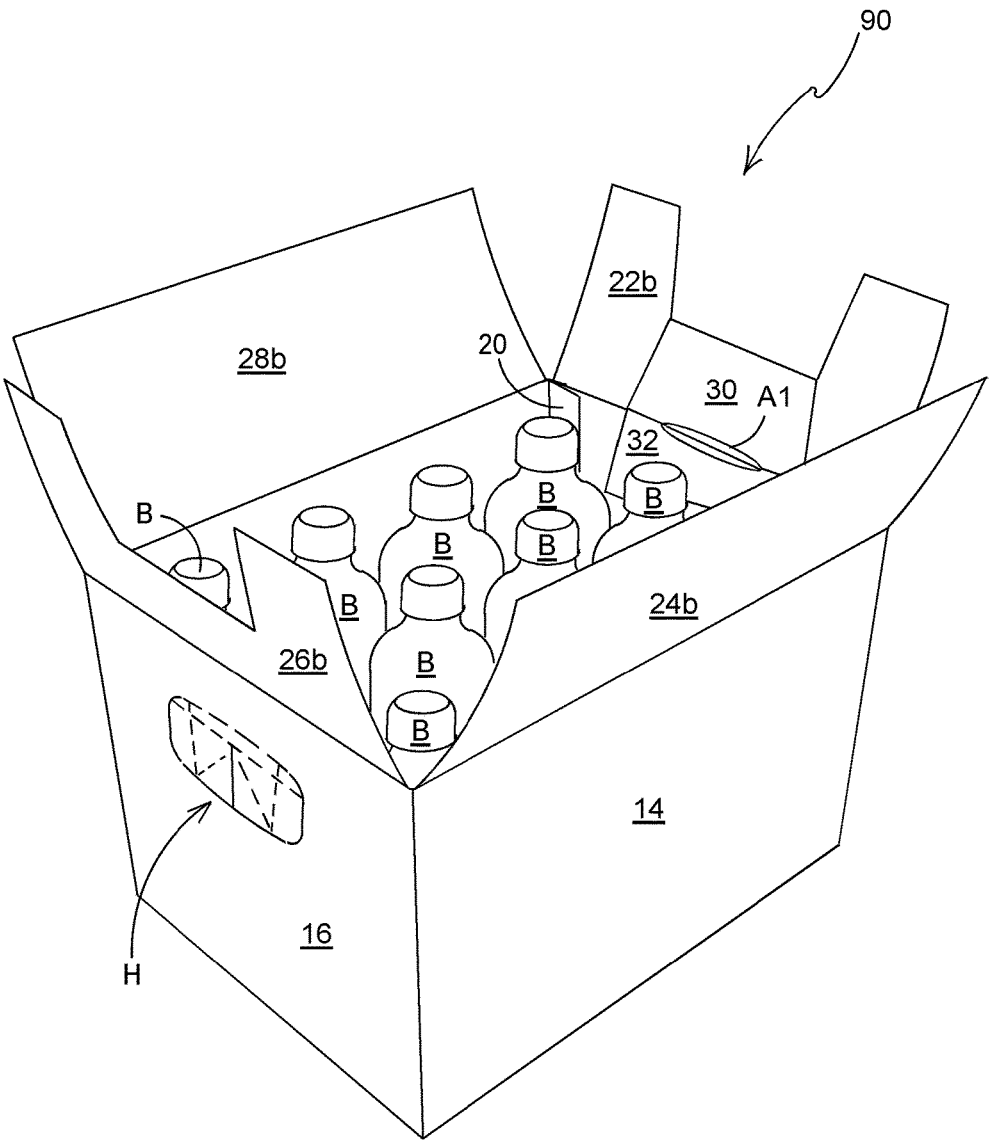

The flat collapsed tubular structure may be closed at a first end by the first end closure panel 22*a*, second end closure panel 24*a*, third end closure panel 26*a* and fourth end closure panel 28*a* and orientated such that the first end closure panel 22*a*, second end closure panel 24*a*, third end closure panel 26*a* and fourth end closure panel 28*a* form a composite base panel. The upper end of the carton 90 remains open such that articles B can be loaded therethrough as shown in FIG. 5.

Once the carton 90 has been loaded with articles B the open ends of the carton 90 are closed.

The method for closing each of the open ends of the carton 90 is substantially the same and will be described by reference to closing the second open end shown in FIG. 5.

Figure 6:
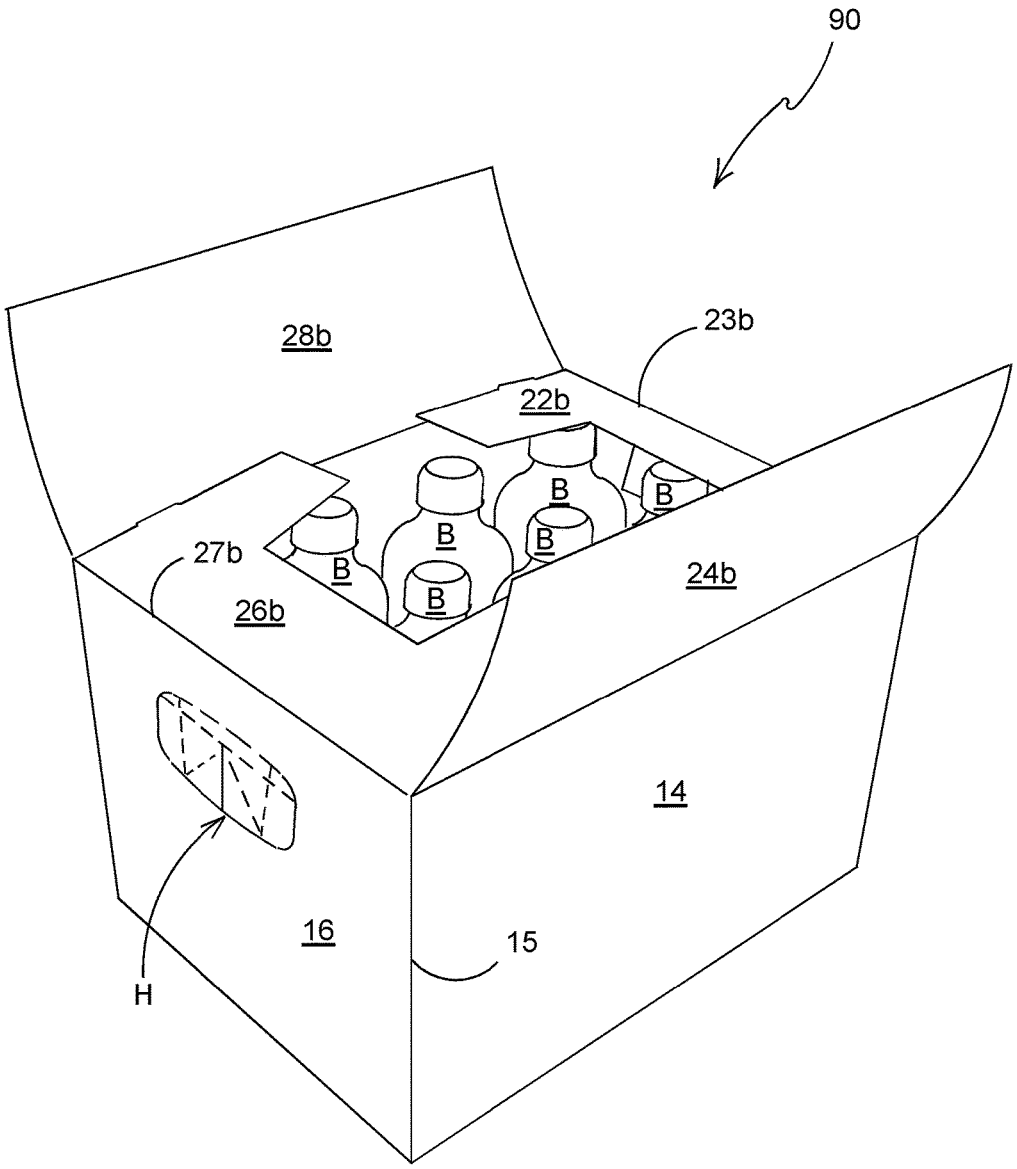
Figure 7:
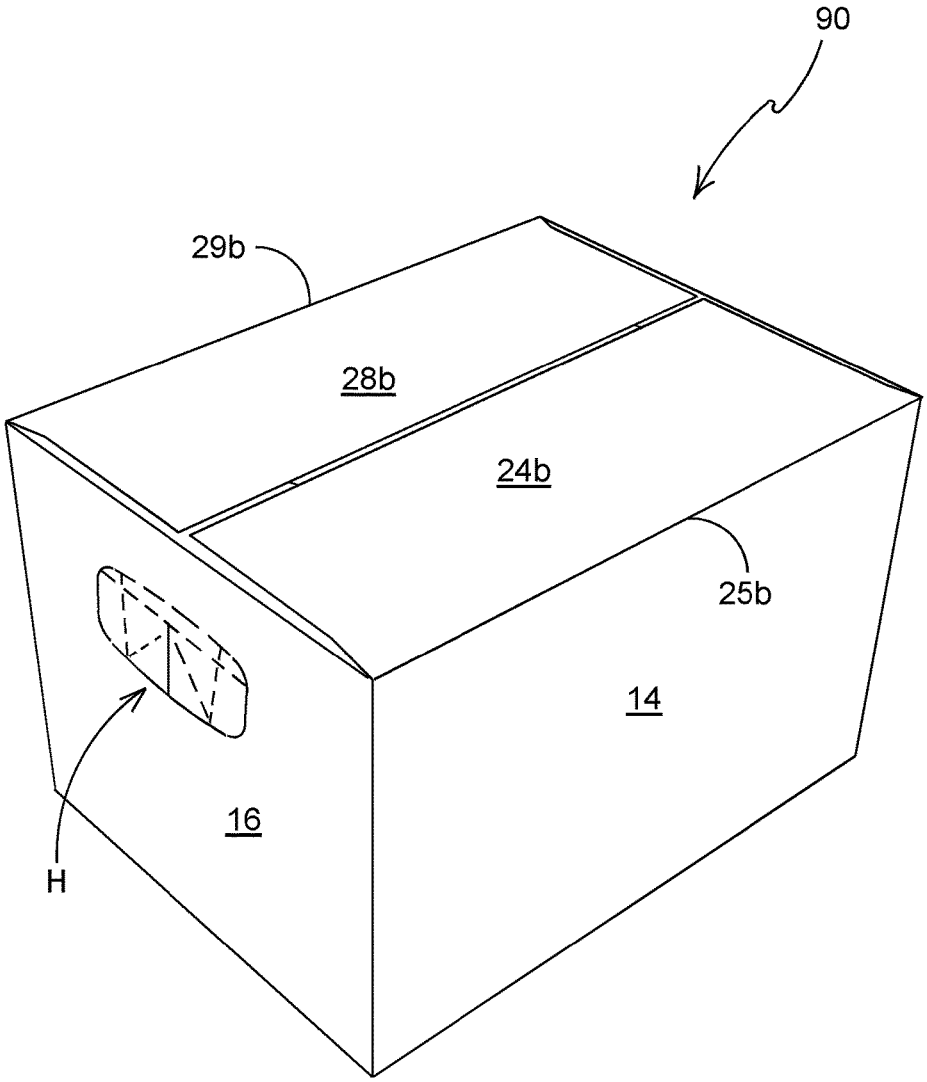
FIG. 7 is a perspective view from above of a carton formed from the blank of FIG. 1.

The second end of the tubular structure is closed by folding the fifth end closure panel 22*b* about fold line 23*b* and by folding the seventh end closure panel 26*b* about fold line 27*b* as shown in FIG. 6.

Glue or other adhesive treatment may be applied to an outer surface of the fifth end closure panel 22*b* and the seventh end closure panel 26*b*. In alternative embodiments glue or other adhesive treatment may be applied to a corresponding portion of an inner surface of sixth end closure panel 24*b*.

The sixth end closure panel 24*b* is then folded about the fold line 25*b* to be brought into contact with each of the fifth and seventh end closure panels 22*b*, 26*b*. The sixth end closure panel 24*b* is secured to each of the fifth and seventh end closure panels 22*b*, 26*b*.

Glue or other adhesive treatment may be applied to an outer surface of the fifth end closure panel 22*b* and the seventh end closure panel 26*b*. In alternative embodiments glue or other adhesive treatment may be applied to a corresponding portion of an inner surface of the eighth end closure panel 28*b*.

The eighth end closure panel 28*b* is then folded about the fold line 29*b* to be brought into contact with each of the fifth and seventh end closure panels 22*b*, 26*b*. The eighth end closure panel 28*b* is secured to each of the fifth and seventh end closure panels 22*b*, 26*b*.

In alternative embodiments the eighth end closure panel 28*b* may be folded about fold line 29*b* before, or simultaneously with, folding the sixth end closure panel 24*b* about fold line 25*b*.

In other embodiments alternative securing means may be employed to secure the end closure panels 22*a*, 24*a*, 26*a*, 28*a*, 22*b*, 24*b*, 26*b*, 28*b* for example, but not limited to, mechanical locking devices such as staples or punch locks integrally formed within the end closure panels 22*a*, 24*a*, 26*a*, 28*a*; 22*b*, 24*b*, 26*b*, 28*b*.

FIG. 6 illustrates the assembled carton 90 forming a package with a plurality of articles B.

The handle structure H in the first side wall panel 12 is substantially the same as the handle structure H in the second side wall panel 16 and the reinforcing structure associated with the fifth end closure panel 22*b* is substantially the same as the reinforcing structure associated with the seventh end closure panel 26*b*. Therefore, the carrying handle will be described in more detail by reference to the handle structure H in the first side wall panel 12 and the reinforcing structure associated with the fifth end closure panel 22*b*.

Figure 8:
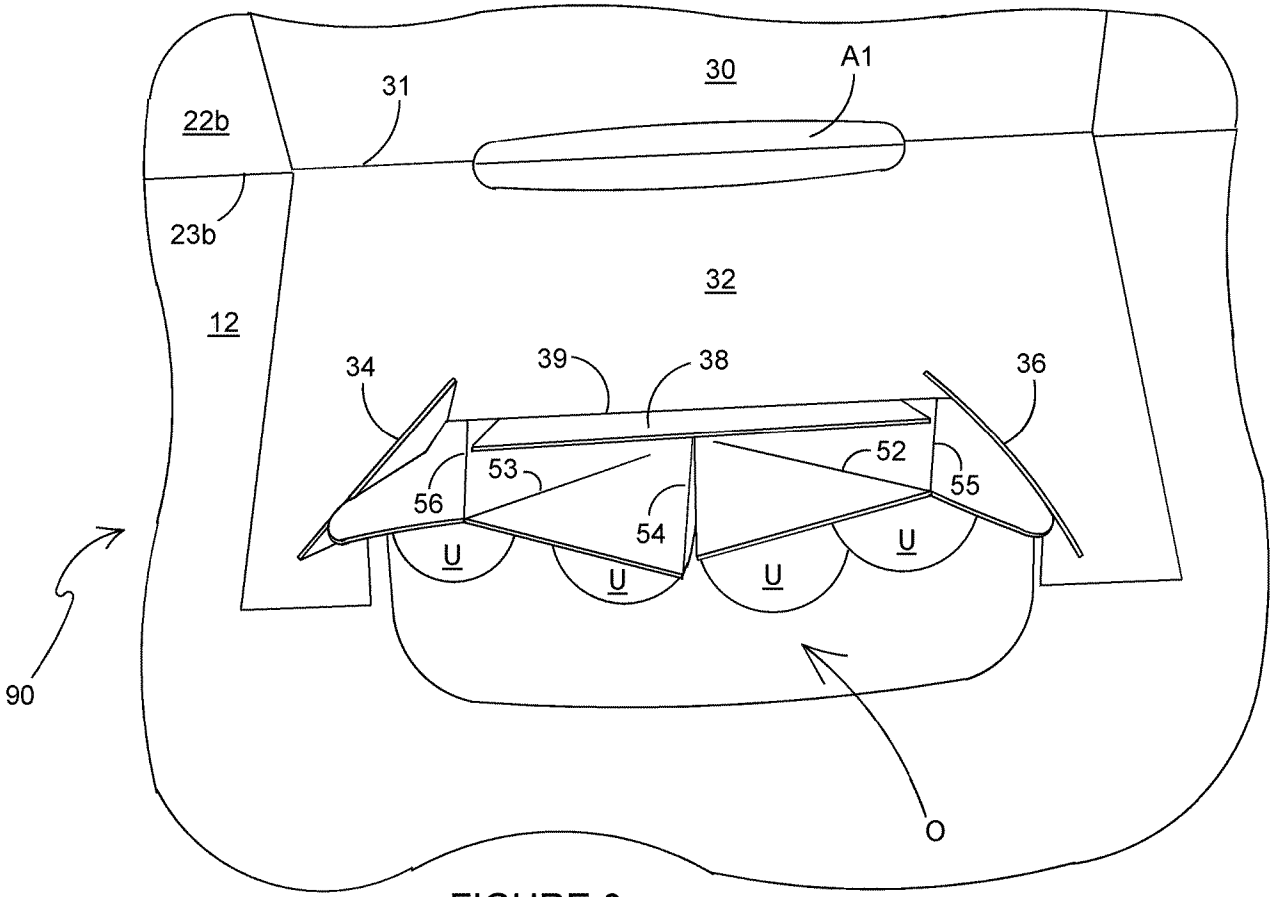
FIG. 8 is an internal view of a portion of the carton of FIG. 7 showing a carrying handle in use.

FIG. 8 shows an internal view of the carrying handle in use. A user U has broken the severance line 60 and pushed the flap 50 internally of the carton. The flap 50 has folded about the third, fourth, fifth and sixth fold lines 52, 53, 55, 56. The second severance line 54 has broken, substantially dividing the flap 50 into two parts. In this way the flap 50 can fold internally of the carton 90; the flap 50 folds about the articles B (not shown in FIG. 8) disposed in the carton 90. The flap 50 may fold about one or more of the third, fourth, fifth and sixth fold lines 52, 53, 55, 56 in response to making contact with one or more articles B disposed in the carton 90.

The cushioning flaps 34, 36, 38 have been displaced out of the plane of the second handle reinforcing panel 32 as a consequence of the internal displacement of the flap 50.

The cushioning flap 38 may act as a mandrel or guide about which the flap 50 may fold.

The cushioning flap 38 may facilitate or guide folding of the flap 50 about the second fold line 57. The cushioning flap 38 may be dimensioned such that a free edge of the cushioning flap 38, the free edge opposes a hinged edge defined by the fold line 39, is arranged to be in registry or aligned with the second fold line 57.

The second handle reinforcing panel 32 provides a second ply of material in the region above the handle structure H, as shown in FIG. 8. The second handle reinforcing panel 32 is hinged to the fifth end closure panel 22*b* indirectly (via first handle reinforcing panel 30) by fold line 33. Fold line 33 is offset from the fold line 23*b*. The fold line 33 is spaced apart from fold line 23*b*. The fold line 33 is inset into the second handle reinforcing panel 32. In this way the fold line 23*b* is uninterrupted; this may provide a more aesthetically desirable appearance. In this way, the fifth end closure flap 22*b* serves as a dust flap reducing the likelihood of ingress of dirt or dust into the carton 90.

The fifth end closure panel 22*b* extends about either side of the first handle reinforcing panel 30 and may extend at least partially about either side of the second handle reinforcing panel 32. That is to say the first reinforcing flap is struck at least in part from material which would otherwise form the fifth end closure panel 22*b*. The first handle reinforcing panel 30 may be struck at least in part from material which would otherwise form the fifth end closure panel 22*b*. The second handle reinforcing panel 32 may also be struck at least in part from the fifth end closure panel 22*b*. Thus the fifth end closure panel 22*b* comprises a greater area for being secured to the sixth and eighth end closure panels 24*b*, 28*b*. Similarly, the seventh end closure panel 26*b* comprises a greater area for being secured to the sixth and eighth end closure panels 24*b*, 28*b*.

It can be appreciated that various changes may be made within the scope of the present invention. For example, the size and shape of the panels and apertures may be adjusted to accommodate articles of differing size or shape.

Whilst the foregoing embodiments have been described with reference to a fully enclosed carton it is envisaged that the reinforced handle structure may be employed in cartons of alternative design such as, but not limited to, wraparound style cartons, basket carriers and top gripping clips.

It will be recognized that as used herein, directional references such as "top", "base", "front", "back", "end", "side", "inner," "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The invention claimed is:

1. A carton for packaging one or more articles, the carton comprising:

a first panel; and a second panel hingedly connected by a first hinged connection to the first panel;

the first panel comprising a handle structure, the handle structure comprising a severance line defining at least in part a handle opening;

the second panel comprising a reinforcing flap hingedly connected to the second panel by a second hinged connection;

wherein the second hinged connection is offset from the first hinged connection, wherein the carton further comprises a third panel opposing the first panel and fourth and fifth opposed panels each extending between the first and third panel such that the first, third, fourth and fifth panels together provide a tubular structure, wherein the second panel forms a dust flap for at least partially closing one of opposed ends of the tubular structure, wherein the first panel has a width extending between the fourth and fifth panels, wherein the first hinged connection extends substantially entirely along the width of the first panel, wherein the first hinged connection is greater in length than the second hinged connection, wherein the reinforcing flap comprises a first handle reinforcing panel and a second handle reinforcing panel hinged to the first handle reinforcing panel along a third hinged connection, wherein the first handle reinforcing panel is folded into face-contacting relationship with a portion of the second panel extending between the first and second hinged connections, wherein the second handle reinforcing panel is folded into face-contacting relationship with a portion of the first panel extending between the handle structure and the first hinged connection.

2. A carton according to claim 1, wherein the second hinged connection is spaced apart from the first hinged connection and is parallel to the first hinged connection.

3. A carton according to claim 1, wherein the reinforcing flap is struck at least in part from the second panel.

4. A carton according to claim 1 wherein the handle structure comprises a handle flap defining at least in part the handle opening.

5. A carton according to claim 1, wherein the first and second hinged connections are spaced apart at a first distance, the second and third hinged connections are spaced apart at a second distance, and the first distance is generally equal to the second distance.

6. A carton according to claim 1, wherein the first handle reinforcing panel is secured to the second panel and the second handle reinforcing panel is secured to the first panel.

7. A blank for forming a carton, the blank comprising:

a first panel; and a second panel hingedly connected by a first hinged connection to the first panel;

the first panel comprising a handle structure, the handle structure comprising a severance line defining at least in part a handle opening;

the second panel comprising a reinforcing flap hingedly connected to the second panel by a second hinged connection;

wherein the second hinged connection is offset from the first hinged connection, wherein the blank further comprises third, fourth and fifth panels, the first, third, fourth and fifth panels together providing a tubular structure when the blank is erected into a set-up carton, wherein the second panel forms a dust flap for at least partially closing one of opposed ends of the tubular structure when the blank is erected into the set-up carton, wherein the fourth and fifth panels are hinged to opposed side edges of the first panel respectively, the first panel having a width extending between the opposed side edges thereof, wherein the first hinged connection extends substantially entirely along the width of the first panel, wherein the first hinged connection is greater in length than the second hinged connection, wherein the reinforcing flap comprises a first handle reinforcing panel and a second handle reinforcing panel hinged to the first handle reinforcing panel along a third hinged connection, wherein, when the blank is erected into the set-up carton, the first handle reinforcing panel is folded into face-contacting relationship with a portion of the second panel extending between the first and second hinged connections, and the second handle reinforcing panel is folded into face-contacting relationship with a portion of the first panel extending between the handle structure and the first hinged connection.

8. A blank according to claim 7, wherein the second hinged connection is spaced apart from the first hinged connection and is parallel to the first hinged connection.

9. A blank according to claim 7, wherein the reinforcing flap is struck at least in part from the second panel.

10. A blank according to claim 7, wherein the second panel extends about at least one side of the reinforcing flap.

11. A blank according to claim 7, wherein the first and second hinged connections are spaced apart at a first distance, the second and third hinged connections are spaced apart at a second distance, and the first distance is generally equal to the second distance.

12. A blank according to claim 7, wherein the second handle reinforcing panel comprises a cutaway shaped complementary to the handle opening.

* * * * *